US006622522B2

(12) United States Patent
Abramson et al.

(10) Patent No.: US 6,622,522 B2
(45) Date of Patent: Sep. 23, 2003

(54) BODY PIERCING JEWELRY

(75) Inventors: Nedra Abramson, Santa Monica, CA (US); Michael Hutterer, Santa Monica, CA (US)

(73) Assignee: Arbitrage Promotions, Inc., Santa Monica, CA (US)

( * ) Notice: Subject to any disclaimer, the term of this patent is extended or adjusted under 35 U.S.C. 154(b) by 0 days.

(21) Appl. No.: 09/877,397

(22) Filed: Jun. 8, 2001

(65) Prior Publication Data

US 2002/0092321 A1 Jul. 18, 2002

Related U.S. Application Data

(60) Provisional application No. 60/210,616, filed on Jun. 9, 2000.

(51) Int. Cl.[7] ..... A44C 7/00
(52) U.S. Cl. ..... 63/12; 63/29.1
(58) Field of Search ..... 63/1.11, 1.16, 63/12, 13, 15.45, 15.5, 15.65, 29.1

(56) References Cited

U.S. PATENT DOCUMENTS

| | | | | | |
|---|---|---|---|---|---|
| 2,146,272 | A | * | 2/1939 | Skoog | 63/15.65 |
| 2,961,855 | A | * | 11/1960 | Newman | 63/15.65 |
| 3,246,388 | A | * | 4/1966 | Pasquale | 29/896.412 |
| 3,693,376 | A | | 9/1972 | Willner | |
| 3,959,989 | A | | 6/1976 | Bhandia | |
| 4,056,951 | A | * | 11/1977 | Black | 63/13 |
| 4,195,492 | A | | 4/1980 | Johnson | |
| 4,928,367 | A | | 5/1990 | Seidman | |
| 5,156,023 | A | * | 10/1992 | Bevolo | 63/20 |
| 5,433,088 | A | | 7/1995 | Mahar | |
| 5,433,090 | A | | 7/1995 | Santiago | |
| 5,581,884 | A | * | 12/1996 | Iacono et al. | 29/896.41 |
| 5,588,309 | A | * | 12/1996 | Chioffe | 63/12 |
| 5,782,107 | A | * | 7/1998 | Glanz | 63/3 |
| 5,887,448 | A | * | 3/1999 | Gilbert et al. | 63/1.16 |
| 5,921,110 | A | * | 7/1999 | Middendorff et al. | 63/1.11 |

FOREIGN PATENT DOCUMENTS

WO 99/03370 1/1999

OTHER PUBLICATIONS

Piercethis2.com website printout for Belly Button Rings and Wayback printout, 10 pages total. May 2003.*

* cited by examiner

*Primary Examiner*—Andrea Chop
(74) *Attorney, Agent, or Firm*—Patterson, Thuente, Skaar & Christensen, P.A.

(57) ABSTRACT

Body jewelry, and more particularly, to body jewelry designed for painless and convenient use with respect to a particular area of a wearer's body, e.g. the navel. Generally, the body piercing jewelry of the present invention comprises a display member, which includes an attachment piece operably adjoined to one or more prongs, and a base member that is releasably securable to the display member. The base member is configured to be easily and painlessly inserted and removed from the pierced areas of the wearer's body.

18 Claims, 4 Drawing Sheets

70
40

45
40
90
60
10

BODY PIERCING JEWELRY

This application claims the benefit of Provisional Application No. 60/210,616, filed on Jun. 9, 2000.

BACKGROUND OF THE INVENTION

1. Field of the Invention

The invention relates to body piercing jewelry, and more particularly, to body piercing jewelry designed for painless and convenient use with respect to various parts of a person's anatomy, e.g. the navel.

2. Description of Related Art

Body piercing jewelry is enjoying increasing popularity in the United States and abroad. The visual, sensual and other effects of body jewelry are becoming better known as its use becomes more mainstream.

The piercing of ears has been practiced by many cultures for thousands of years. The practice of wearing ornamentation in the ear lobes or cartilage of a wearer's ears has prompted individuals to develop earrings that are aesthetically pleasing as well as safe and painless to wear. Examples of such earrings have been disclosed in U.S. Pat. Nos. 4,195,492, 5,433,088, and 4,928,367.

One common body piercing jewelry design is the captive bead ring ("CBR"), also known as the ball closure ring ("BCR"). With this design, a bead includes holes or dimples in opposite sides thereof. The bead is positioned between the ends of a round ring, and is not permanently fixedly attached thereto but instead is held in position by the tension of the ring. A wide variety of both beads and rings are available. Rings can be circular, for example, or triangular, oval, octagonal, or of other shapes. Decorative beads include spheres, cubes, hearts, and other shapes. Various jewels, stones, and other accessories can be incorporated into the bead. Examples of various embodiments of the captive bead ring design are disclosed in International Application No. WO 99/03370.

Many factors affect how tightly the bead is held in place with respect to the ring. These factors include the dimensions of the bead, the depth of the holes or dimples therein, the hardness and gauge of the ring, and the size of the ring. The tighter the bead is held in place, the more difficult it is to remove from the ring. Ring-expanding pliers or other tools often are used to release the bead from the ring. Removing the bead from the ring, with or without pliers, however, is generally a two-person operation, and generally prevents or discourages the wearer of such jewelry from changing out the bead or ring by herself or himself. As a result, the wearer of this jewelry is generally unable to frequently exchange the jewelry for alternatives. A need has arisen to overcome these and other disadvantages.

Another common body piercing jewelry design is the dumbbell design. The dumbbell design comprises a rod, which supports a ball on each end. Normally, one ball is adjoined to the rod by a screw feature or other clamping device. Such a configuration allows for insertion of the rod through a pierced portion of the body and subsequent securement of the jewelry to the body by adjoining the removable ball to the rod with a screw feature or clamping feature. The dumbbell design provides an adequate body piercing jewelry style, but is limited by the number of ornament types that can be implemented when utilizing this design. Furthermore, the securing feature of the dumbbell design can be awkward and difficult for an individual to engage and disengage due to the small ball screw or clamp that is required for securement.

As is evident from the previous description, the body piercing rings previously disclosed have a number of disadvantages. One disadvantage with the BCR and dumbbell designs are that they can be difficult to engage and disengage. Body piercing jewelry that includes tightly secured beads or balls, or screw type mechanisms may be difficult to engage and disengage due to the smallness of their parts and difficult actions required to adequately secure them. These designs thereby cause the wearer to expend additional time and effort. Another disadvantage of utilizing screw type mechanisms is that such mechanisms accumulate dirt or other material on the threads thereby decreasing the efficiency securing and removing the jewelry and also increasing the likelihood of infection. Finally, the previously disclosed designs do not allow for simple changing of ornamentation without removal of the entire device inserted into the pierced part of the body.

SUMMARY OF THE INVENTION

The present invention relates to body jewelry, and more particularly, to body jewelry designed for painless and convenient use with respect to a particular area of a wearer's body, e.g. the navel. Generally, the body piercing jewelry of the present invention comprises a display member that includes an attachment piece operably adjoined to two or more prongs, and a base member that is releasably securable to the display member. The base member is configured to be easily and painlessly inserted and removed from the pierced areas of the wearer's body.

Multiple display members or rings can be easily changed in and out of a base member or backing, without specialized tools and without the assistance of another person. Furthermore, display members or rings can be easily changed in and out of the base without removing the base from the pierced portion of the wearer's body. Embodiments of the invention thus support the use and purchase of multiple rings or other display elements, and thus afford the wearer multiple avenues of creativity and expression.

Safety and hygiene are also promoted by utilizing the body piercing jewelry of the present invention. Insertion of a base member into the body can be accomplished relatively easily, and the base member can be changed out easily for purposes of washing, disinfections, etc.

Finally, the configuration of the body piercing jewelry of the present invention offers optimum presentation of the display member while still providing maneuverability of the entire piece of jewelry with the movement of the wearer. Other advantages and features will be apparent to those of ordinary skill.

DESCRIPTION OF PREFERRED EMBODIMENTS

Figure 1:
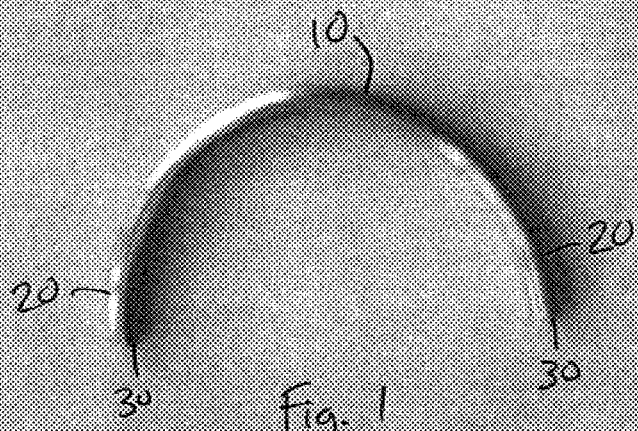
FIG. 1 is a perspective view of a backing or base member according to an embodiment of the invention.

Referring to the drawings, the following embodiments of the present invention will be disclosed or suggested with respect to FIGS. 1–6. As previously mentioned, the body piercing jewelry of the present invention generally comprises base member 10. Generally, base member 10 is hollow or includes two or more terminal ends 20 that have apertures 30. The body piercing jewelry further comprises one or more display members 40. The display members 40 include an attachment piece 45 and one or more prongs 70 operably connected to the attachment piece 45. The prongs 70 are configured to be releasably securable with the base member 10 by insertion of the prongs 70 into a corresponding adapted aperture 30. The base member 10 is further configured to be easily and painlessly inserted and removed from the pierced areas of the wearer's body.

FIG. 1 depicts one embodiment that includes the backing or base member 10 of the body piercing jewelry of the present invention. Base member 10 preferably is generally hollow, either throughout its entire extent or at least at end terminal ends 20. The hollow or partially hollow nature of the base member 10 creates two terminal end apertures 30 at terminal ends 20. Base member 10 is preferably manufactured in the general form of a tube or wire and may be made of gold, titanium, surgical stainless steel, or any combinations thereof. However it is noted that the base member 10 may also be made of other materials generally compatible with insertion and retention with the human body. In various embodiments of the present invention the materials utilized in manufacture of the base member 10 may be made of a material that is slightly flexible and memory resilient, such as surgical stainless steel or nitinol. The slightly flexible and memory resilient material allows the base member 10 to be maneuvered into a position to receive the prongs 70 adjoined to the attachment member 45 and also allows the base member 10 to return to its resting configuration after the display member 40 has been removed from the base member 10. Such memory resilient material is beneficial in providing an additional retention force that releasably secures the base member 10 to the display member 40,50. Alternatively, it is noted that the base member 10 in other embodiments may be made of a rigid nonflexible material. Such a non-flexible base member 10 is often utilized with display members 40,50 that include flexible and memory resilient material and/or prongs 70 that include flexible and memory resilient material.

The base member 10 is constructed for insertion into the body and is generally adapted for long-term or permanent retention in the body, e.g. in the region of the navel or other anatomic areas or structures. In some embodiments of the present invention the base member is shaped in a rounded or half-moon configuration. However, the shape of the base may be any suitable shape that accommodates simple and painless insertion into the pierced portion of the wearer's body. According to preferred embodiments, terminal ends 20 and terminal end apertures 30 remain generally exposed to the outside of the body.

Figure 2:
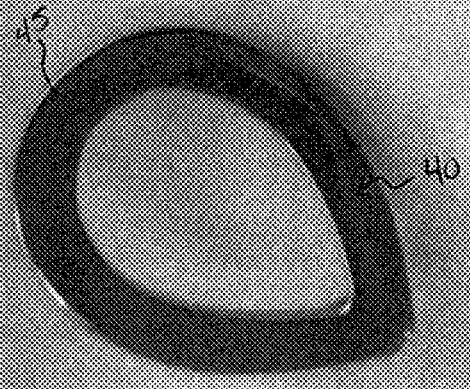
FIG. 2 is a front view of a ring or display member according to an embodiment of the invention.
Figure 3:
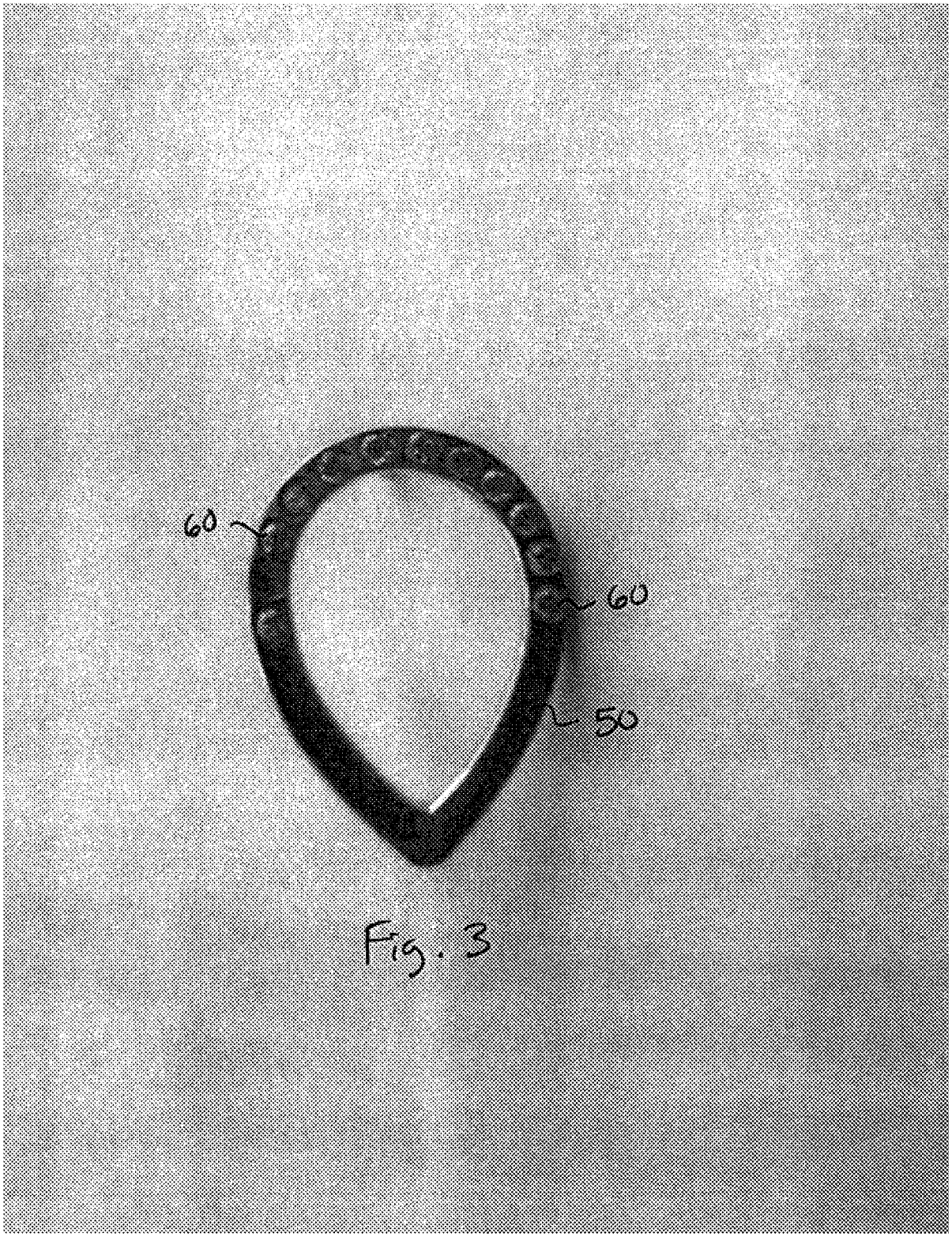
FIG. 3 is a front view of a ring or display member according to an alternative embodiment of the invention.

FIG. 2 shows one embodiment of a ring or display member 40. The illustrated attachment member 45 of FIG. 2 is formed in a general teardrop shape and is constructed of gold. Of course, other shapes as depicted in FIGS. 7–12, such as triangles, squares, rectangles, half-moon, stars, ovals, etc., and other suitable materials, such as silver, titanium, surgical stainless steel, plastic or any combinations thereof, are contemplated according to embodiments of the invention. FIG. 3, for example, shows alternate display member 50, which is formed of a silver or silver-colored material and which supports decorative elements 60. The decorative elements 60 can include stones or other naturally occurring or synthetic materials, e.g. diamonds, sapphires, zirconium, etc.

Figure 5:
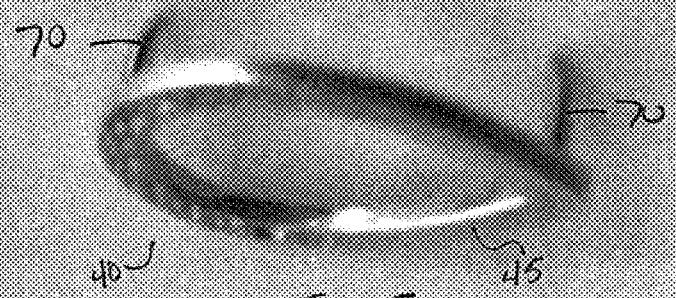
FIG. 5 is a perspective view of the FIG. 3 ring or display member.
Figures 4, 6:
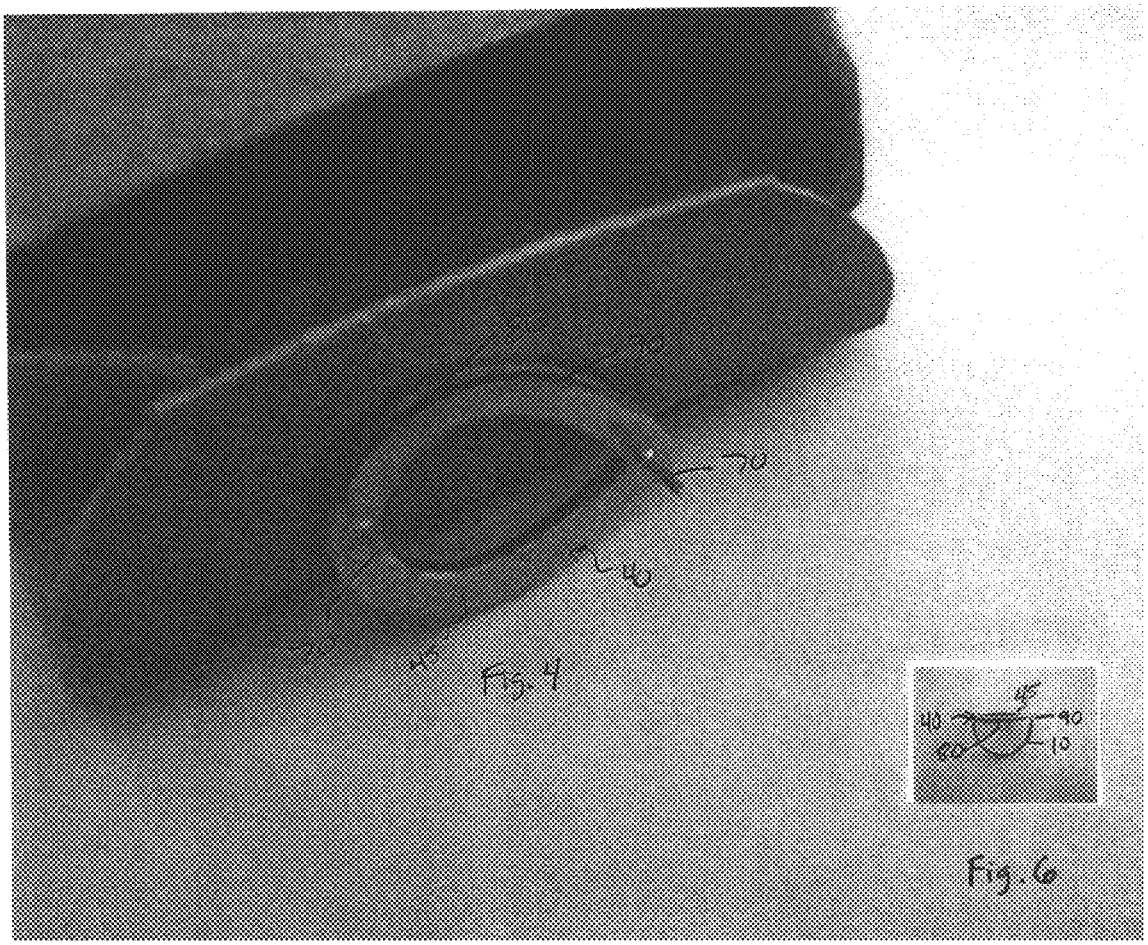
FIG. 4 is a perspective view of the FIG. 2 ring or display member.
FIG. 6 is a perspective view of the FIG. 1 backing or base member and the FIG. 2 ring or display member connected together.
Figure 7:
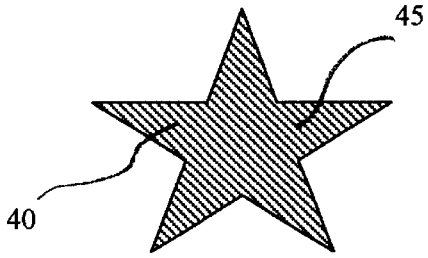
FIG. 7 is a front view of a ring or display member according to an embodiment of the invention.
Figure 8:
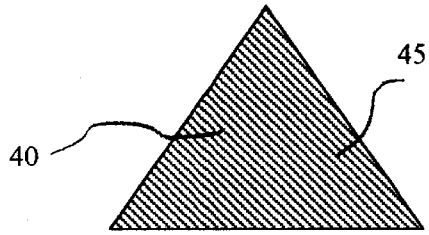
FIG. 8 is a front view of a ring or display member according to an embodiment of the invention.
Figure 9:
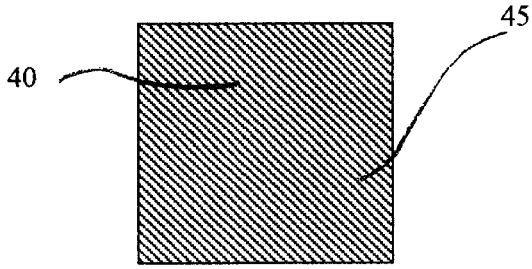
FIG. 9 is a front view of a ring or display member according to an embodiment of the invention.
Figure 10:
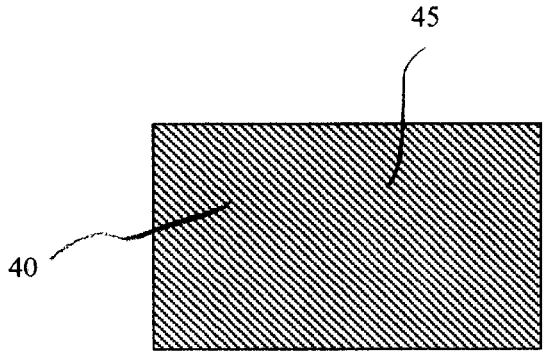
FIG. 10 is a front view of a ring or display member according to an embodiment of the invention.
Figure 11:
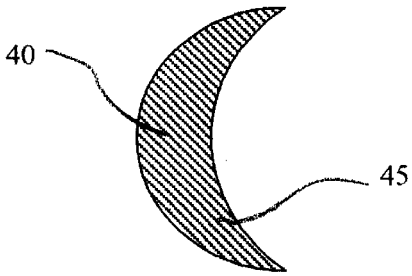
FIG. 11 is a front view of a ring or display member according to an embodiment of the invention.
Figure 12:
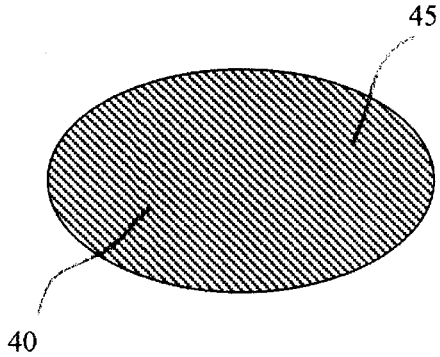
FIG. 12 is a front view of a ring or display member according to an embodiment of the invention.

Display members 40 each include laterally extending prongs 70, as shown in FIGS. 4 and 5, respectively. The prongs 70 are preferably one-piece with their respective attachment piece 45 and may angle inward or outward as each extends from the attachment member 45 so as to apply a biasing force against the base member 10 when adjoined. Such a biasing force retains the connection of the display member 40 with the base member 10. However, it is noted that the prongs 70 are always constructed for easy insertion into and removal from the terminal end apertures 30 of the base member 10 while the base member 10 is retained within the body of the wearer.

The display member 40,50 and/or the prongs 70 may be made of gold, silver, titanium, surgical stainless steel, or any combinations thereof. However, it is noted that the display member 40,50 and/or prongs may also be made of other suitable materials. In various embodiments of the present invention the materials utilized in manufacture of the display member 10 and/or prongs may be made of a material that is slightly flexible and memory resilient, such as surgical stainless steel or nitinol, thereby allowing them to enter the base member 10 and return to their rest configuration after removal from the base member 10. Alternatively, in other embodiments of the present invention, the display member 40,50 and/or the prongs 70 are made of a rigid nonflexible material. In some of these embodiments where the display members 40,50 and/or prongs are made of a rigid nonflexible material, the base member 10 may include a flexible memory resilient material. As previously suggested, the memory resilient material allows for insertion and retention of the display member 40, 50 to the base member 10.

Advantageously, no special tools or equipment are required for insertion and removal of display members 40, 50, and the wearer can perform the insertion and removal functions by herself or himself, without requiring assistance from another person. This ease-of-use factor is especially desirable for switching in and out multiple display members 40, 50 on a regular, e.g. daily or weekly, basis, in a manner heretofore believed unknown in the prior art. Regarding various embodiments of the present invention, it is possible to allow the base member 10 to remain inserted in the pierced portion of the wearer's body for extended periods of time and simply replace only the display member 40,50 on a regular basis.

FIG. 6 is a perspective view of the display member 40 attached to the base member 10. Of course, display member 50 is also constructed for insertion into a corresponding base member 10, but to simplify this description only display member 40 will be referenced in this regard. Prongs 70 extend into terminal end apertures 30 of base member 10, in the manner described previously. Furthermore, the insertion of the prongs 70 positions the display member 40 in the optimum position on the body for viewing the display member 40, while still allowing for enough movement of the entire piece of body piercing jewelry so as to prevent discomfort and/or injury to the wearer.

FIGS. 4 and 6 also illustrates one of two opposed accessory apertures or depressions 80, disposed generally diametrically on the circumferential surface 90 of display member 40. These accessory depressions 80 are optional and can be used to support the display member 40 in the manner of a traditional captive bead ring (with prongs 70 facing outwardly or being capped), or on a display stand, in a casing, etc. One or more accessory apertures or depressions 80 can also be used to support an accessory device (not shown) off of display member 40, e.g. a hoop, a second ring, or some other device or ornamentation. The accessory device can be adjoined to the display member 40 in a manner similar to the administration of a ring to a bead, as with a captive bead ring.

In operation, the body piercing jewelry of the present invention is administered to a wearer by threading the base member 10 through a pierced part of the wearer's body until the terminal ends 20 and apertures 30 extend outward from the wearer's skin. Once the base member 10 has been inserted through the pierced part of the wearer's body, the prongs 70 are inserted into the apertures 30, thereby adjoining the display member 40,50 to the base member 10. As previously suggested, the prongs 70 or base member 10 may comprise a memory resilient material. The memory resilient material allows for movement of the prongs 70 or base member 10 thereby providing for efficient insertion and retention of the display member 40,50 with the base member 10. Finally, one or more optional accessory devices (not shown), such as a hoop, ring or other similar ornament, may be maneuvered over the circumferential surface 90 of the display member 40,50 until portions of the accessory device are positioned in the accessory depressions 80.

Embodiments of the present invention may also include a display member 40, 50 that includes prongs 70 having apertures (not shown) and a base member 10 that includes extensions (not shown) instead of apertures. In operation, the display members 40, 50 and the base members 10 adjoin to each other in a similar fashion as the embodiments explained above. However, with these embodiments, the extensions from the base member 10 would releasably insert into the apertures of the prongs 70, thereby adjoining the base member 10 with the display member 40,50.

The invention has been described with respect to specific illustrative embodiments, and the figures should not be held to limit the invention. A wide variety of shapes, sizes, material types, colors, and other characteristics are contemplated, for example, not just those shown in the figures. Although particular embodiments of the invention are well suited for use in the navel, other anatomical locations are contemplated as well. Multiple other features and advantages according to the invention will be apparent from this description.

What is claimed is:

1. Body piercing jewelry, comprising:

a base member including an intermediate portion and two or more spaced apart attachment elements wherein said attachment elements are present on an attachment plane and said intermediate portion is completely offset from said attachment plane, the base member adapted for insertion into a piercing having a pair of spaced apart pierced openings presented on a common surface, said two or more spaced apart attachment elements adapted to project outwardly through said pierced openings from said surface while said intermediate portion is adapted to remain below said surface; and a display member including an attachment piece operably adjoined to two or more attachment members, each of said attachment members adapted for operable connection with a respective one of said base member attachment elements.

2. The body piercing jewelry of claim 1, wherein said base member is rounded.

3. The body piercing jewelry of claim 1, wherein said attachment elements include apertures for receiving said attachment members.

4. The body piercing jewelry of claim 3, wherein said base member is hollow.

5. The body piercing jewelry of claim 1, wherein said display member is shaped in one of the shapes selected from the group consisting of teardrop, star, triangle, square, rectangle, oval and half-moon.

6. The body piercing jewelry of claim 1, wherein said display member further comprises one or more accessory depressions.

7. The body piercing jewelry of claim 6, further comprising one or more accessory devices adjoined to the display member at the accessory depressions.

8. The body piercing jewelry of claim 1, wherein said display member includes one or more materials selected from the group consisting of gold, silver, nitinol, stainless steel, titanium, plastic and aluminum.

9. The body piercing jewelry of claim 1, wherein said display member further includes one or more decorative elements.

10. The body piercing jewelry of claim 1, wherein said attachment members comprise a memory resilient material.

11. The body piercing jewelry of claim 1, wherein said base member comprises a memory resilient material.

12. The body piercing jewelry of claim 1, wherein said plurality of attachment members extend inward from the display member.

13. The body piercing jewelry of claim 1, wherein said plurality of attachment members extend outward from the display member.

14. The body piercing jewelry of claim 1, wherein said plurality of attachment members are positioned on opposite ends of the display member.

15. The body piercing jewelry of claim 1, wherein said base member includes one or more materials selected from the group consisting of gold, nitinol, stainless steel, titanium and aluminum.

16. A method of wearing body piercing jewelry, comprising the steps of:

inserting a base member into a pierced part of a wearer's body, said base member including two or more terminal ends;

releasably securing a display member, which includes an attachment piece operably adjoined to two or more prongs, with the terminal ends of said base member.

17. The method of wearing body piercing jewelry of claim 16, wherein the display member further comprises one or more accessory depressions.

18. The method of wearing body piercing jewelry of claim 17 further comprising the step of adjoining an accessory device to the display member of the body piercing jewelry.

* * * * *